US011492160B2

(12) United States Patent
Mader et al.

(10) Patent No.: US 11,492,160 B2
(45) Date of Patent: Nov. 8, 2022

(54) SEALING TOOL AND METHOD FOR SEALING TRAYS

(71) Applicant: MULTIVAC SEPP HAGGENMUELLER SE & CO. KG, Wolfertschwenden (DE)

(72) Inventors: Andreas Mader, Dietmannsried (DE); Thomas Zedelmaier, Boehen (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 273 days.

(21) Appl. No.: 16/864,606

(22) Filed: May 1, 2020

(65) Prior Publication Data

US 2020/0346802 A1 Nov. 5, 2020

(30) Foreign Application Priority Data

May 2, 2019 (DE) ..... 102019206280.6

(51) Int. Cl.
*B65B 31/02* (2006.01)
*B65B 7/28* (2006.01)
*B65B 51/10* (2006.01)

(52) U.S. Cl.
CPC ..... *B65B 31/028* (2013.01); *B65B 7/2878* (2013.01); *B65B 51/10* (2013.01)

(58) Field of Classification Search
CPC ..... B65B 31/028; B65B 31/046; B65B 31/02; B65B 7/2878; B65B 7/164; B65B 7/162;
(Continued)

(56) References Cited

U.S. PATENT DOCUMENTS 3,481,100 A * 12/1969 Bergstrom ..... B65B 31/02 53/282
3,659,393 A * 5/1972 Richter ..... B65B 31/021 53/511

(Continued)

FOREIGN PATENT DOCUMENTS

DE 10 2012 005 891 A1 9/2013
EP 1 842 776 A2 10/2007

(Continued)

OTHER PUBLICATIONS

German Office Action dated Jan. 7, 2020, Application No. 10 2019 206 280.6, Applicant Multivac Sepp Haggenmueller SE & Co. KG, 8 Pages.

(Continued)

*Primary Examiner* — Dariush Seif
(74) *Attorney, Agent, or Firm* — Brooks Kushman P.C.

(57) ABSTRACT

A sealing tool for a tray sealing machine, comprising an upper tool and a lower tool with a main body having a tray depression for receiving at least a part of a tray to be sealed, and a tray carrier, wherein a gas channel runs through the tray carrier. The sealing tool is characterized in that the tray carrier comprises a first plate with a first pressing surface and a second plate with a second pressing surface and the first plate has a first depression which extends from the first pressing surface, wherein the first depression forms at least a section of the gas channel when the first plate and the second plate are pressed against each other at the first and the second pressing surface, respectively.

14 Claims, 7 Drawing Sheets

(58) Field of Classification Search
CPC ..... B65B 7/16; B65B 51/10; B65B 51/14; B65B 9/04; B65B 25/001; B29C 66/131; B29C 66/53461; B29C 66/8322; B29C 66/849; B29C 66/00145; B29C 65/18; B65D 81/2076
USPC ..... 53/403, 405, 329.3, 432, 510; 426/392, 426/396
See application file for complete search history.

(56) References Cited

U.S. PATENT DOCUMENTS 3,956,867 A * 5/1976 Utz ..... B65B 31/021 53/511
4,137,688 A * 2/1979 Utz ..... B65B 47/10 53/433
4,229,927 A * 10/1980 Day ..... B65B 31/021 53/511
5,419,097 A * 5/1995 Gorlich ..... B65B 25/067 53/298
5,475,965 A * 12/1995 Mondini ..... B29C 66/876 53/329.3
5,509,252 A * 4/1996 Gorlich ..... B65B 25/067 53/510
6,305,149 B1 * 10/2001 Gorlich ..... B26F 3/08 83/16
8,171,703 B2 * 5/2012 Arlinghaus ..... B65B 9/04 53/436
9,481,480 B2 * 11/2016 Harlacher ..... B65B 31/043
2003/0196412 A1 * 10/2003 Foulke, Jr. ..... B65B 11/52 53/329.3
2008/0148690 A1 * 6/2008 Seggern ..... B29C 66/81427 53/433
2010/0115890 A1 * 5/2010 Granili ..... B65B 31/028 53/427
2011/0072764 A1 * 3/2011 Daniek ..... B65B 7/164 53/556
2014/0331611 A1 * 11/2014 Meyer ..... B29C 66/1312 53/445
2016/0194101 A1 * 7/2016 Palumbo ..... B65B 9/04 53/511
2016/0355283 A1 * 12/2016 Capitani ..... B29C 65/02
2017/0305586 A1 * 10/2017 Rizzi ..... B29C 66/131
2018/0155074 A1 * 6/2018 Gabler ..... B65B 31/028
2018/0178932 A1 * 6/2018 Palumbo ..... B65B 9/04
2019/0016487 A1 * 1/2019 Capitani ..... B29C 65/224
2019/0031379 A1 * 1/2019 Palumbo ..... B65B 31/028
2019/0055040 A1 * 2/2019 Capitani ..... B65B 41/04
2019/0062032 A1 * 2/2019 Mader ..... B65B 61/18
2021/0122513 A1 * 4/2021 Rizzi ..... B65B 31/046

FOREIGN PATENT DOCUMENTS

WO 2011/092103 A1 8/2011
WO 2016/193006 A1 12/2016
WO 2018/193382 A1 10/2018

OTHER PUBLICATIONS

European Search Report dated Oct. 2, 2020, Application No. 20163626.3-1016—Applicant MULTIVAC Sepp Haggenmueller SE & Co. KG, 8 pages.

* cited by examiner

SEALING TOOL AND METHOD FOR SEALING TRAYS

CROSS-REFERENCE TO RELATED APPLICATIONS

This application claims foreign priority benefits under 35 U.S.C. § 119(a)-(d) to German patent application number DE 102019206280.6, filed May 2, 2019, which is incorporated by reference in its entirety.

TECHNICAL FIELD

The disclosure relates to a sealing tool as well as to a method for evacuating and/or gas-flushing and sealing packaging trays.

BACKGROUND

Tray sealing machines and respective sealing tools are known, for example, from DE 10 2012 005 891 A1. They usually comprise an upper tool and a lower tool. In order to be able to evacuate and/or gas-flush packaging trays before they are closed by sealing a top film on, conventional sealing tools have channels that are configured for extracting and/or introducing gas. Since the top film, which is initially present as a film web, in this process is clamped between the upper tool and the lower tool, existing sealing tools comprises channels that are in part branched, but in any case difficult to access, so that both the interior of the packaging to be sealed as well as the surrounding chamber can be evacuated and/or gas-flushed to the degree desired.

A tool is additionally known from WO 2011 092 103 A1 that has a so-called clamping frame. It is adapted to first clamp the top film to the tool upper part. In WO 2011 092 103 A1, channels are provided within this clamping frame and used for gas-flushing the packaging tray to be sealed.

Such conventional tools have the disadvantage that they are complicated to manufacture due to the channels described. What adds to that, in particular with tray sealing machines that process food, is that the channels make the regular cleaning of the machine and the tool difficult. Both factors increase the costs for purchasing and operating the tool.

SUMMARY

It is therefore an object of the disclosure to specify a sealing tool as well as a method for evacuating and/or gas-flushing and sealing packaging trays which enables simplified production and cleaning of the tool and thereby generates lower costs.

The disclosure provides a sealing tool for a tray sealing machine. The sealing tool comprises an upper tool and a lower tool with a main body having a tray depression for receiving at least a portion of a tray to be sealed, and a tray carrier, wherein a gas channel runs through the tray carrier. The sealing tool is characterized in that the tray carrier comprises a first plate with a first pressing surface and a second plate with a second pressing surface and the first plate has a first depression extending from the first pressing surface, wherein the first depression forms at least a section of the gas channel when the first plate and the second plate are pressed against each other at the first and the second pressing surface, respectively.

By providing a first and a second plate, the tray carrier may be divided along a separation surface, which may be shaped as desired. The separation surface may be a plane to which the closing direction of the sealing tool, in particular the direction of motion in which the upper tool and the lower tool move towards each other, runs vertically.

A depth of the depression, which may be defined perpendicular to the first pressing surface, may be provided in particular smaller than the extension of the depression parallel to the first pressing surface. Said depth may be smaller than a thickness of the first plate, wherein the thickness of the first plate may also be defined perpendicular to the pressing surface.

The formation of a section of the gas channel may be effected, for example, in that the second pressing surface covers an opening surface of the depression which may run parallel to the first pressing surface. The above-described configuration may facilitate manufacturing and in particular cleaning of the tray carrier, since after separating the first plate from the second plate, the section of the gas channel partially formed by the depression is more accessible.

It is advantageous if the main body and the second plate are connected to each other unmovably relative to one another during the operation of the sealing tool. In this way, both may be moved with the same drive which reduces the drive and control complexity. It is particularly advantageous if the first plate is connected to the second plate during operation of the sealing tool, so that the first and the second plate are arranged unmovably relative to each other. This may further reduce the drive and control complexity.

For the connection of the second plate to the main body and/or the connection of the first plate to the second plate, toolless attachment devices may be provided. In particular, toolless attachment devices may be provided which hold the main body, the second plate, and the first plate unmovable to each other during operation of the sealing tool. Toolless attachment devices may significantly reduce the assembly and disassembly effort. Cleaning may also be simplified.

In a variant, a protrusion may be provided on the second pressing surface, the protrusion being configured to extend into the depression in the pressed-on state. This may enable selectively influencing the flow direction of the gas in the gas channel, for example, to give the gas flow a certain direction. It is conceivable that the depression in the pressed-on state together with the protrusion forms a funnel-shaped end section of the gas channel. The projection may be formed integrally with the second plate.

The end section, which may also be designed having any desired shape other than a funnel shape, may be provided, for example, as an inlet or outlet for a gas. A section which leads directly into a sealing chamber of the sealing tool may be considered as being the end section of the gas channel. Funnel-like shaping of the end section of the gas channel may enable the selected collection and/or distribution of a gas flow. In this manner, for example, the flow rate of the gas may be influenced.

In a further variant, the second plate may comprise a second depression extending from the second pressing surface, wherein in the pressed-on state, the first depression and the second depression together form a section of the gas channel. This section may be an end section or another section of the gas channel. With regard to the definition of the term "depression", the explanations given above with reference to the first depression are correspondingly applicable to the second depression.

The disclosure also relates to a method for evacuating and/or gas-flushing and sealing packaging trays with by sealing tool comprising a lower tool with a main body and a tray carrier, which comprises a first plate and a second plate, as well as an upper tool. The method comprises inserting a packaging tray into the second plate of the tray carrier, wherein the second plate comprises a second pressing surface, closing the sealing tool by pressing the upper tool and the lower tool against each other, pressing the second plate of the tray carrier against the first plate, so that the second pressing surface and a first pressing surface provided on the first plate bear against each other, thereby forming at least a section of a gas channel for evacuating and/or gas-flushing the packaging tray, evacuating and/or gas-flushing the packaging tray, and sealing the tray with a top film. Pressing the two plates on and the associated formation of the gas channel may also enable the use of a tray carrier which is easier to manufacture and better to clean due to the division into a first and a second plate.

In a further variant, the method may comprise clamping the top film onto the upper tool by the first plate before closing the sealing tool. In this manner, the use of a separate clamping frame for clamping the top film to the upper tool may be dispensed with, whereby the number of parts may remain constant compared to conventional sealing tools or methods with a single part tray carrier and clamping frame.

It is conceivable that pressing the first plate against the second plate occurs while the sealing tool closes. This may enable executing the pressing of the first plate against the second plate and closing of the sealing tool simultaneously, thus saving time, which may increase the efficiency of the method or the tray sealing machine.

In a further variant, pressing the first plate against the second plate may occur before the sealing tool is closed. This may be particularly advantageous in embodiments in which the top film is not to be clamped by the first plate onto the upper tool. It is in particular conceivable that, as already mentioned above, the first plate is connected to the second plate in such a way that they are arranged unmovable relative to each other during the operation of the sealing tool. Furthermore, it is conceivable, in addition, that the main body of the lower tool is connected in an unmovable manner to the first plate and the second plate during operation.

BRIEF DESCRIPTION OF THE DRAWINGS

The disclosure relates to a sealing tool as well as to a method of the type described above. In the following, an embodiment of the disclosure is further illustrated with reference to drawings.

DETAILED DESCRIPTION

Figure 1:
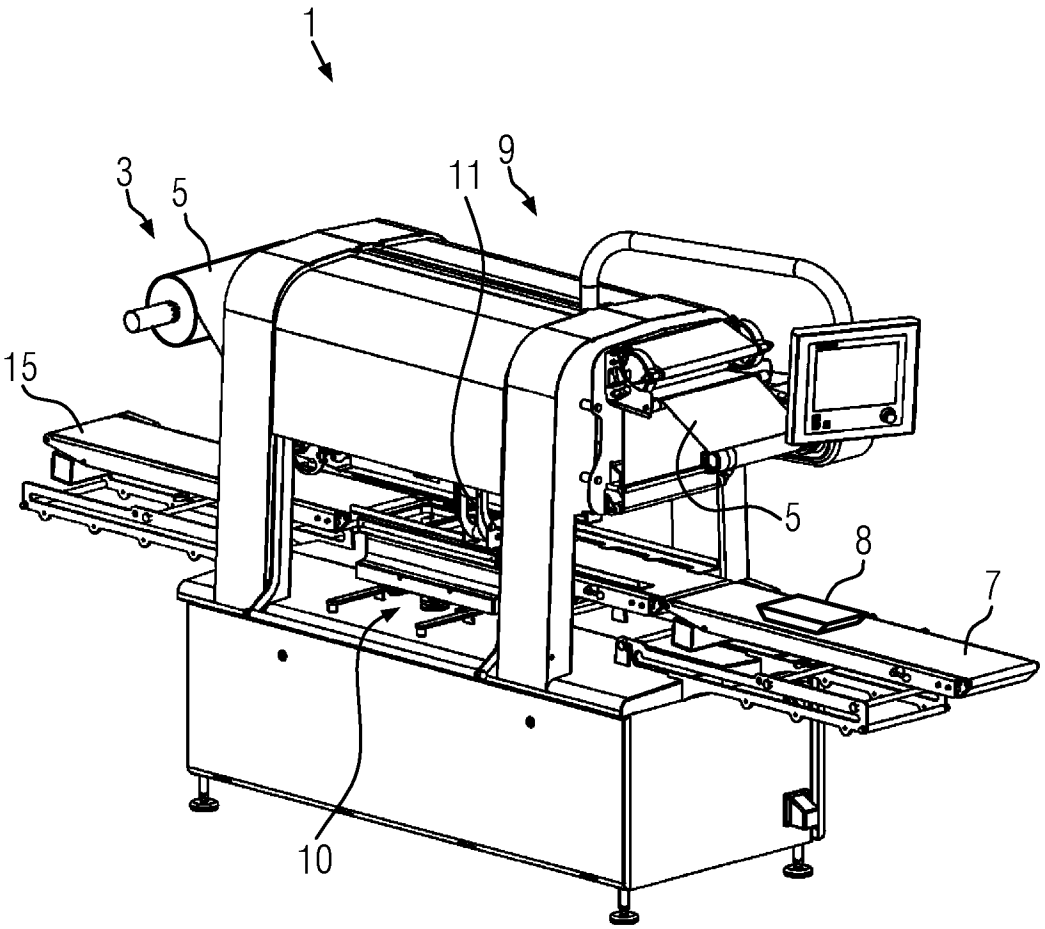
FIG. 1 shows a schematic perspective view of a packaging machine.

FIG. 1 shows an example of a packaging machine 1. It is a tray sealing machine. Packaging machine 1 may have a feed belt 7. It may furthermore have a sealing station 9. Trays 8 that are filled but at this time not yet sealed may be transported to sealing station 9 by feed belt 7. Trays 8 may be relocated with a gripper device 11 into sealing station 9 and there sealed with a top film 5 (film) supplied from above, for example, by sealing top film 5 thereonto. For this purpose, sealing station 9 may comprise a sealing tool 10 which shall be described later in more detail. The packagings thus completed may be relocated by gripper device 11 from sealing station 9 to a discharge belt 15.

After sealing top film 5 thereonto, regions of top film 5 corresponding to the packagings or packaging assemblies may be cut out of the web of top film 5 in sealing station 9. There remains a film lattice of top film 5 which is wound by a device 3 for winding film 5.

Figure 2:
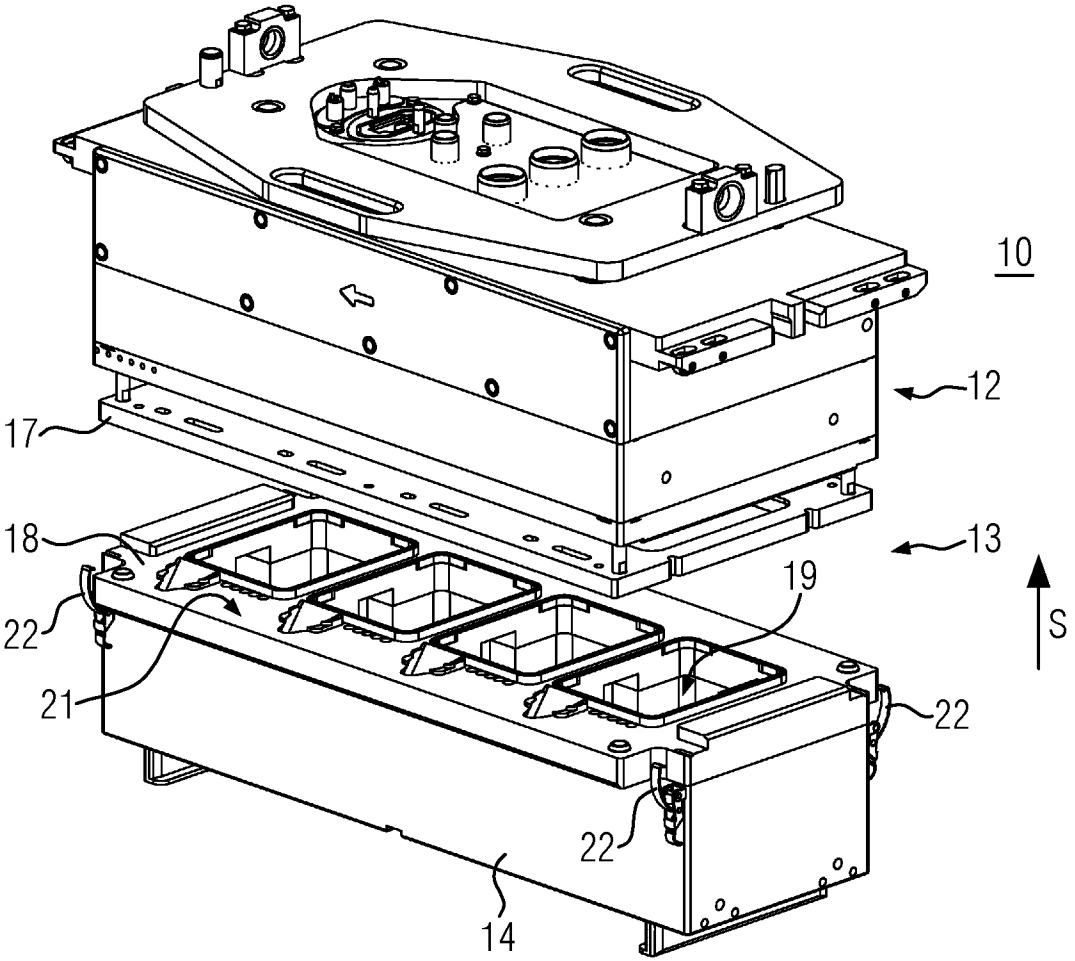
FIG. 2 shows a schematic perspective view of a sealing tool in an open state.

Sealing tool 10 can be seen in a perspective view in FIG. 2. As in the embodiment shown, sealing tool 10 may comprise an upper tool 12 and a lower tool 13. They may be moved towards each other in a closing direction S in order to close sealing tool 10. Lower tool 13 may contain a main body 14, as shown in the figure. It may be mounted, for example, onto a lifting unit 6 (not shown), which may be configured to move lower tool 13 towards upper tool 12 in closing direction S. Lower tool 13 may further have a tray carrier 16 (see FIG. 4). As can be seen in the figure, the latter may be provided on the side of main body 14 that faces towards upper tool 12.

Tray carrier 16 may comprise a first plate 17 and a second plate 18. Even if in FIG. 2, first plate 17 is shown closer to upper tool 12 than to the other components of lower tool 13, it (first plate 17) is, due to its function, to be regarded as part of lower tool 13. A tray depression 19 may be provided in main body 14 and may be configured to accommodate at least part of tray 8 to be sealed.

Figure 4:
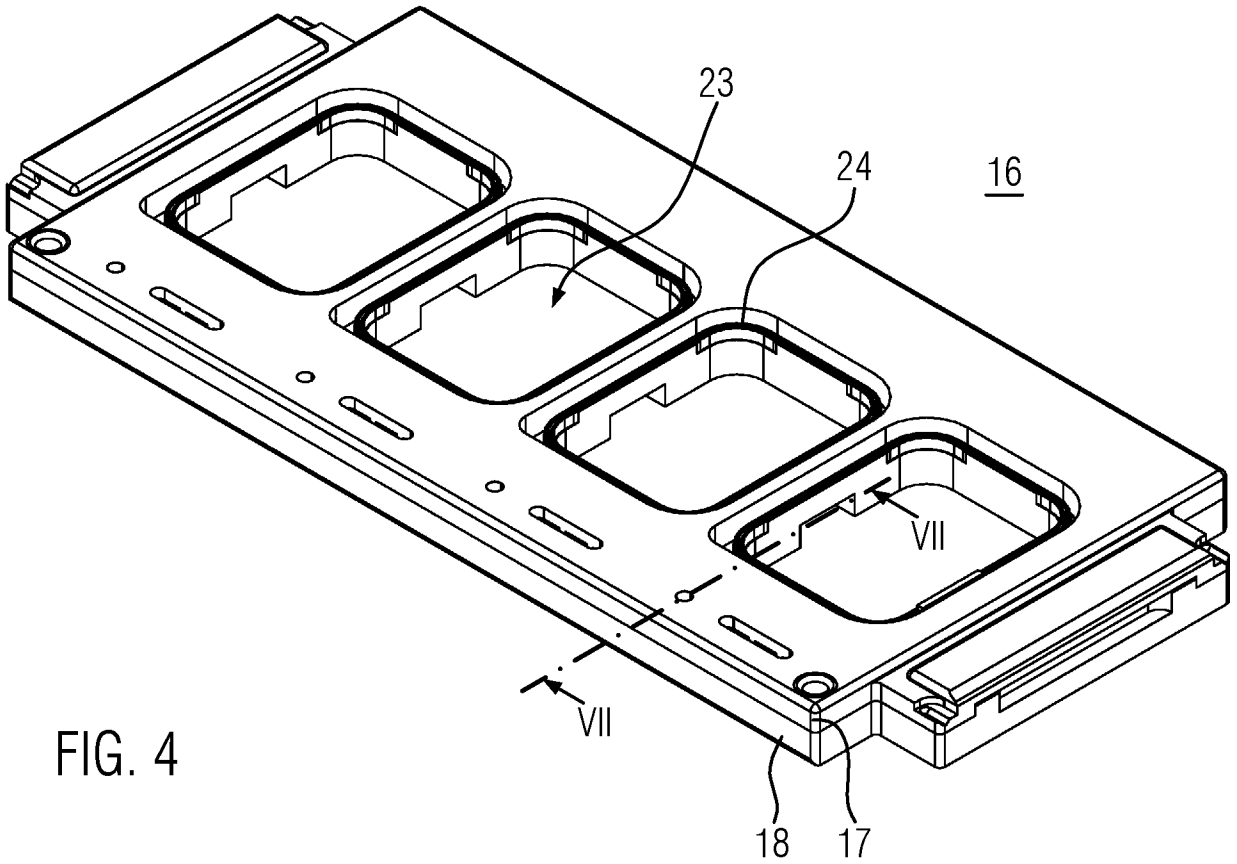
FIG. 4 shows a schematic perspective view of a tray carrier which comprises a first plate and a second plate which can be seen in the state pressed against each other.
Figure 5:
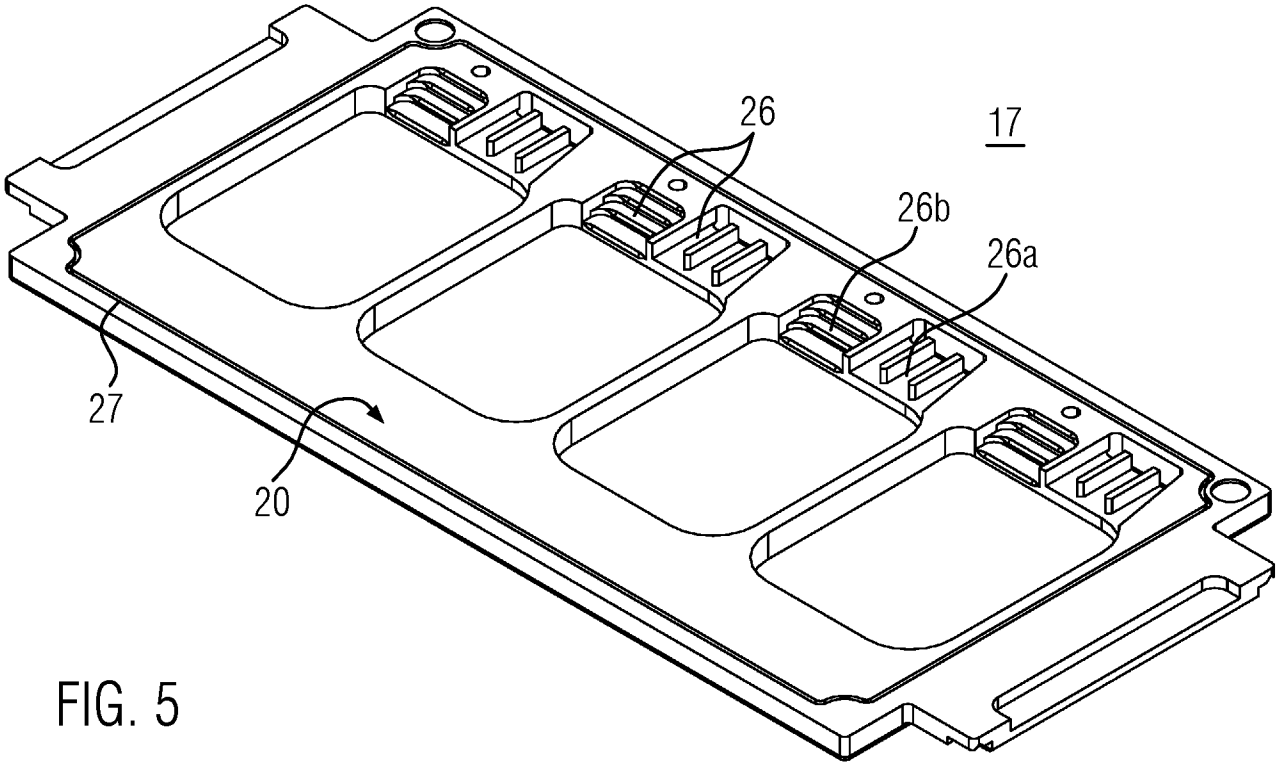
FIG. 5 shows a schematic perspective view of the first plate of the tray carrier with a view onto the first pressing surface.

First plate 17 may have a first pressing surface 20 (see FIG. 5). Second plate 18 may have a second pressing surface 21. First plate 17 and second plate 18 may be pressed against each other at first pressing surface 20 and second pressing surface 21, thus forming tray carrier 16. This shall be explained in more detail with reference to FIGS. 4-6.

Figure 3:
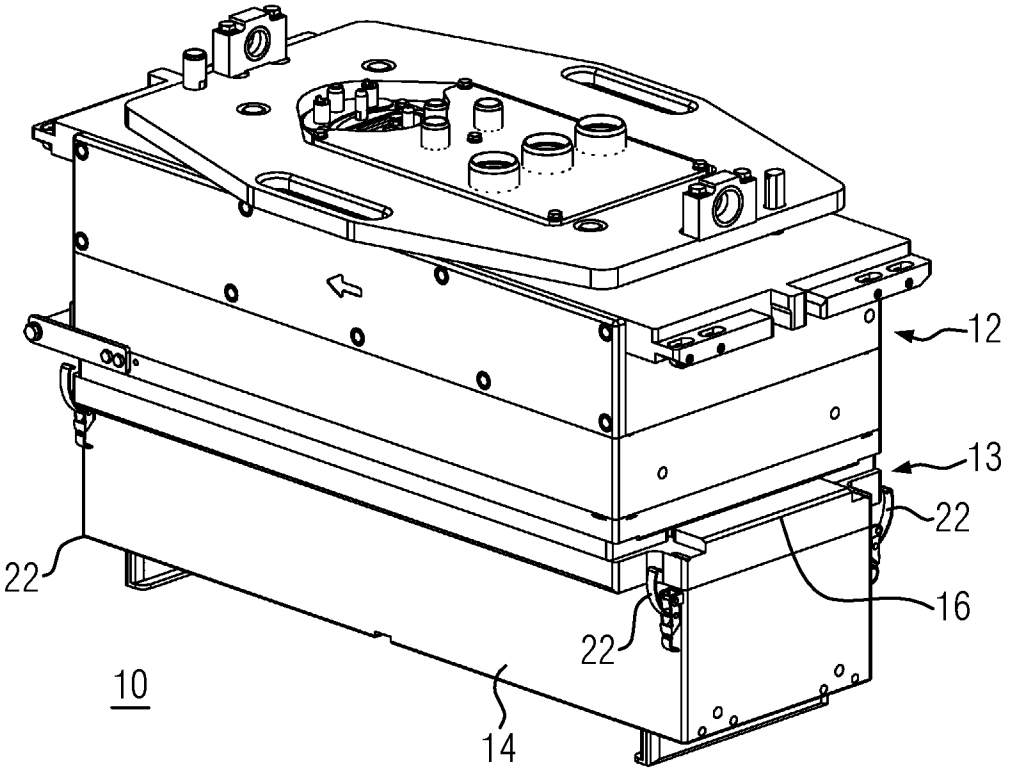
FIG. 3 shows a schematic perspective view off sealing tool in a closed state.

Attachment devices 22 can be seen in FIG. 2. As shown in the present embodiment, they may be configured to connect second plate 18 to main body 14 in such a way that, during the operation of sealing tool 10, main body 14 and second plate 18 are arranged unmovable relative to each other. The person skilled in the art recognizes that in other embodiments than the one shown, attachment devices 22 may be adapted to connect also first plate 17 to main body 14 and second plate 18 in such a way that first and second plates 17, 18 as well as main body 14 are connected to each other in such a way that they are arranged unmovable relative to each other during the operation of sealing tool 10. FIG. 3 shows sealing tool 10 in a closed state.

In FIG. 4, tray carrier 16 is shown in a perspective view as a separate assembly containing first plate 17 and second plate 18. Tray carrier 16 may have tray openings 23. They may form a lower part of a sealing chamber, for example, together with tray depressions 19 in the main body of the lower tool. Tray carrier 16 may further have a support edge 24. Such may each be provided circumferentially around one of tray openings 23. For inserting trays 8 into tray carrier 16, a flange provided on tray 8 may be placed on support edge 24. Support edge 24 may serve as an abutment for a sealing plate. As shall be explained in more detail later with reference to FIG. 7, tray carrier 16 may have gas-flushing and or evacuation openings 25 (see FIG. 7).

FIG. 5 illustrates a perspective view of the first plate. Compared to the illustration in FIG. 4, first plate 17 is rotated by 180° about an axis running parallel to the longer side of tray carrier 16. This makes first pressing surface 20 visible. Also, a first depression 26 can now be seen which may be provided in first plate 17. It may extend in particular from first pressing surface 20, preferably in a direction perpendicular to the first pressing surface. In the first pressing surface, a groove 27 may additionally be provided into which a seal may be placed.

Different types of first depressions 26 having different shapes may be provided. As in the present embodiment, for example, a first evacuation depression 26*a* may be provided. In addition, a first gas-flushing depression 26*b* may be provided. As already indicated by the designation, in the state of tray carrier 16 shown in FIG. 4, the former may form a section of an evacuation channel, while the latter may, in the state of tray carrier 16 shown in FIG. 4, form a section of a gas-flushing channel.

Figure 6:
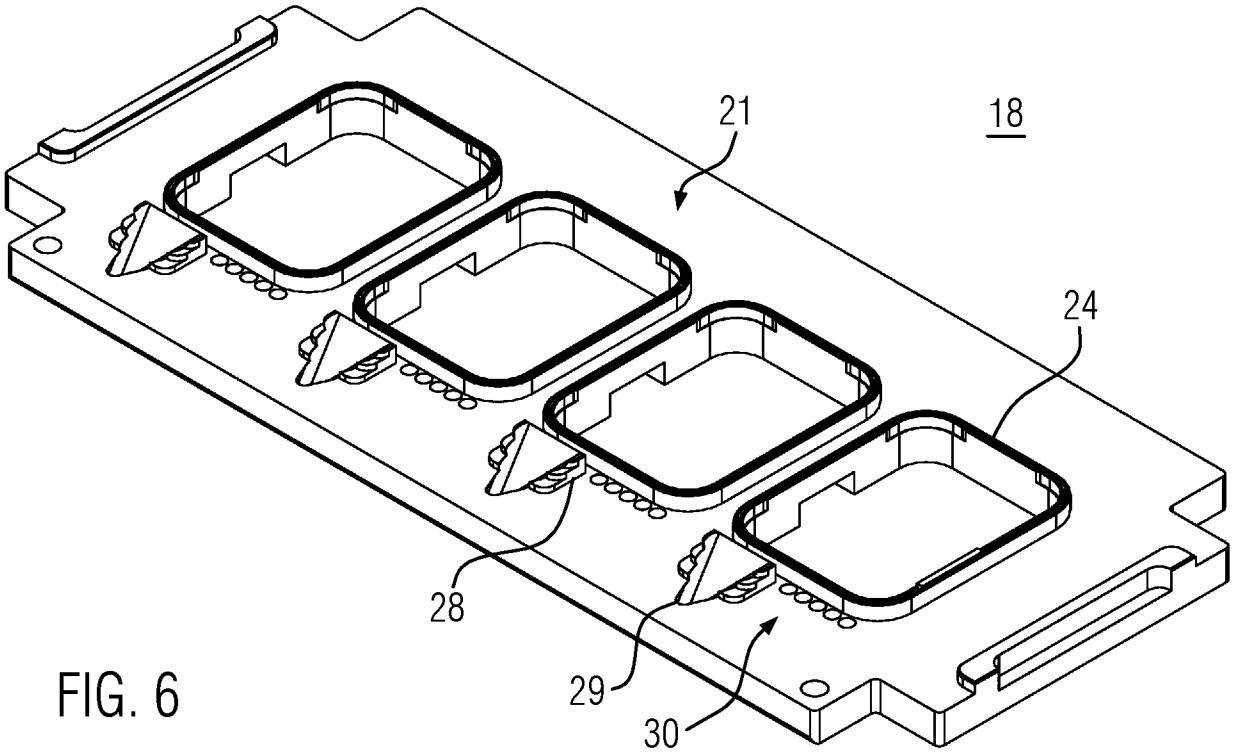
FIG. 6 shows a schematic perspective view of the second plate of the tray carrier with a view onto the second pressing surface.

FIG. 6 shows second plate 18. Compared to FIG. 4, missing first plate 17 exposes second pressing surface 21. As shown in FIG. 6, a protrusion 28 may be provided on second pressing surface 21. In the state of tray carrier 16 shown in FIG. 4, the protrusion 28 may be configured to extend into the first depression, in particular into first gas-flushing depression 26*b*. Furthermore, a second depression 29 may be provided which may extend from second pressing surface 21. It can also be seen that second plate 18 may have evacuation holes 30. They may be adapted to connect first depression 26 to the lower part of the sealing chamber in the state shown in FIG. 4. It may thus be prevented, in particular, that tray 8 received in tray carrier 16 deforms undesirably during the evacuation.

Figure 7:
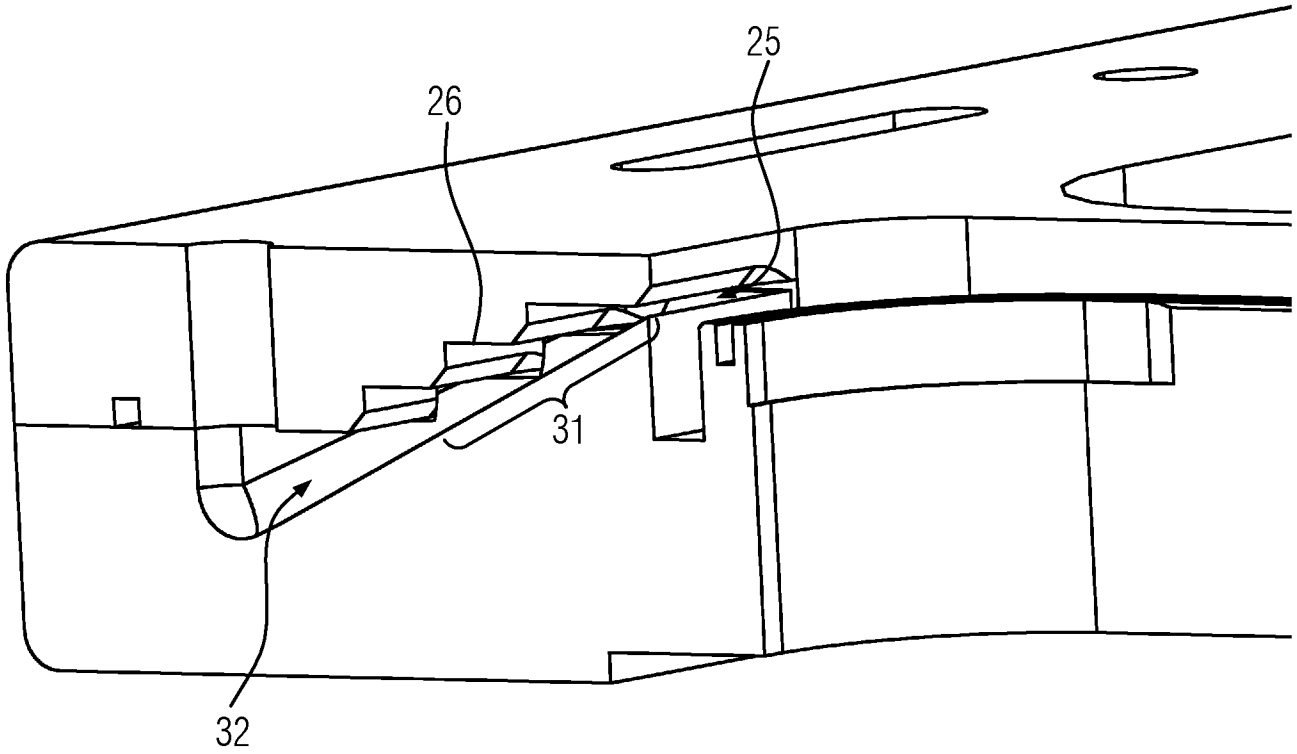
FIG. 7 shows a schematic sectional view from the perspective indicated at VII-VII in FIG. 4.

FIG. 7 shows a sectional view of tray carrier 16 in the state shown in FIG. 4. Now it can be seen that first depression 26 may form a section 31 of a gas channel 32, when first plate 17 and second plate 18 are pressed against each other at first and second pressing surface 20, 21, respectively. As in the present embodiment, section 31 may be an end section 31 of gas channel 32. However, any section of the gas channel may be formed by first depression 26. In particular, end section 31 may be an inlet or an outlet through which gas may be introduced into or discharged from gas channel 32. Even if the facts were illustrated figuratively on the basis of first gas-flushing depression 26*b* with reference to FIG. 7, a person skilled in the art recognizes that the explanations are also transferable to first evacuation depression 26*a*.

What is claimed is:

1. A sealing tool for a tray sealing machine, the sealing tool comprising:

an upper tool; and a lower tool with a main body, which has a tray depression for receiving at least a part of a tray to be sealed, and with a tray carrier, wherein a gas channel runs through the tray carrier;

wherein the tray carrier comprises a first plate with a first pressing surface and a second plate with a second pressing surface, wherein the first plate further has a first depression extending from the first pressing surface, wherein the first depression forms at least a section of the gas channel when the first plate and the second plate are pressed against each other at the first pressing surface and the second pressing surface, respectively, and wherein a protrusion is provided on the second pressing surface, and the protrusion is configured to extend into the first depression when the first plate and the second plate are pressed against each other.

2. The sealing tool according to claim 1, wherein the main body and the second plate are connected to each other in an unmovable manner during operation of the sealing tool.

3. The sealing tool according to claim 1, wherein the first plate is connected to the second plate during operation of the sealing tool, so that the first plate and the second plate are arranged unmovable relative to each other.

4. The sealing tool according to claim 1, wherein, when the first plate and the second plate are pressed against each other, the first depression together with the protrusion forms a funnel-shaped end section of the gas channel.

5. The sealing tool according to claim 1, wherein the second plate comprises a second depression extending from the second pressing surface, and wherein, when the first plate and the second plate are pressed against each other, the first depression and the second depression together form a section of the gas channel.

6. A method for evacuating and/or gas-flushing and sealing packaging trays by a sealing tool, which comprises an upper tool and a lower tool, wherein the lower tool includes a main body and a tray carrier, which includes a first plate and a second plate, the method comprising:

inserting a packaging tray into the second plate of the tray carrier, wherein the second plate comprises a second pressing surface;

closing the sealing tool by pressing the upper tool and the lower tool against each other;

pressing the second plate of the tray carrier against the first plate, so that the second pressing surface and a first pressing surface provided on the first plate bear against each other, thereby forming at least a section of a gas channel for evacuating and/or gas-flushing the packaging tray;

evacuating and/or gas-flushing the packaging tray; and sealing the tray with a top film;

wherein the first plate further has a first depression extending from the first pressing surface, a protrusion is provided on the second pressing surface, and the protrusion is configured to extend into the first depression when the second plate is pressed against the first plate.

7. The method according to claim 6, further comprising clamping the top film onto the upper tool by the first plate before closing the sealing tool.

8. The method according to claim 6, wherein pressing the first plate against the second plate occurs while the sealing tool closes.

9. The method according to claim 6, wherein pressing the first plate against the second plate occurs before the sealing tool is closed.

10. The method according to claim 6, wherein the first depression forms the at least a section of the gas channel when the second plate is pressed against the first plate.

11. The method according to claim 6, wherein the main body and the second plate are connected to each other in an unmovable manner during operation of the sealing tool.

12. The method according to claim 6, wherein the first plate is connected to the second plate during operation of the sealing tool, so that the first plate and the second plate are arranged unmovable relative to each other.

13. The method according to claim 6, wherein, when the second plate is pressed against the first plate, the first depression together with the protrusion forms a funnel-shaped end section of the gas channel.

14. The method according to claim 6, wherein the second plate comprises a second depression extending from the second pressing surface, and wherein, when the second plate is pressed against the first plate, the first depression and the second depression together form a section of the gas channel.

* * * * *